US009873580B2

(12) United States Patent
Hayashi et al.

(10) Patent No.: US 9,873,580 B2
(45) Date of Patent: Jan. 23, 2018

(54) SHEET CONVEYER DEVICE

(71) Applicant: BROTHER KOGYO KABUSHIKI KAISHA, Nagoya-shi, Aichi-ken (JP)

(72) Inventors: Masayoshi Hayashi, Aichi (JP); Yuji Hori, Gifu (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 14/959,826

(22) Filed: Dec. 4, 2015

(65) Prior Publication Data

US 2016/0159597 A1 Jun. 9, 2016

(30) Foreign Application Priority Data

Dec. 8, 2014 (JP) ..... 2014-248222

(51) Int. Cl.
*B65H 7/02* (2006.01)
*B65H 7/12* (2006.01)
(Continued)

(52) U.S. Cl.
CPC ..... *B65H 7/125* (2013.01); *B65H 3/063* (2013.01); *B65H 3/0653* (2013.01); *B65H 7/04* (2013.01);
(Continued)

(58) Field of Classification Search
CPC ..... B65H 2407/30; B65H 2511/13; B65H 2511/16; B65H 2511/50; B65H 2513/512; B65H 2553/80; B65H 5/00; B65H 7/00; B65H 7/02; B65H 7/20; B65H 2553/00; B65H 7/125; B65H 3/063; B65H 3/0653; B65H 7/04; B65H 2511/52; B65H 2513/53; B65H 2553/30; B65H 2553/51; B65H 2701/1311; B65H 2801/39
See application file for complete search history.

(56) References Cited

U.S. PATENT DOCUMENTS 7,347,419 B2 * 3/2008 Sano ..... B65H 5/062 271/242
7,654,522 B2 * 2/2010 Tonami ..... B65H 7/125 271/262
(Continued)

FOREIGN PATENT DOCUMENTS

JP 2004-231404 A 8/2004
JP 2011-26066 A 2/2011
JP 2012-56727 A 3/2012

*Primary Examiner* — Thomas Morrison
(74) *Attorney, Agent, or Firm* — Merchant & Gould P.C.

(57) ABSTRACT

A sheet conveyer device, including a transmitter to transmit ultrasonic waves arranged on a conveyer path to face a first side of a sheet; a receiver to receive the ultrasonic waves arranged on the conveyer path to face a second side of the sheet; a measurement unit to measure an intensity of the received ultrasonic waves; and a determination unit to determine a condition of a range in the conveyer path between the transmitter and the receiver among a first condition, wherein no sheet is present in the range, a second condition, in which a sheet is present in the range, and a third condition, in which a plurality of sheets are present in the range, based on intensities of the ultrasonic waves measured by the measurement unit in a plurality of periods separately after transmission of the ultrasonic waves, is provided.

17 Claims, 7 Drawing Sheets

(51) Int. Cl.
*B65H 7/04* (2006.01)
*B65H 3/06* (2006.01)

(52) U.S. Cl.
CPC ..... *B65H 2511/52* (2013.01); *B65H 2513/53* (2013.01); *B65H 2553/30* (2013.01); *B65H 2553/51* (2013.01); *B65H 2701/1311* (2013.01); *B65H 2801/39* (2013.01)

(56) References Cited

U.S. PATENT DOCUMENTS

| | | | | |
|---|---|---|---|---|
| 8,313,096 | B2 * | 11/2012 | Yamagishi | B65H 7/125 271/10.03 |
| 2004/0150155 | A1 | 8/2004 | Okitsu et al. | |
| 2005/0184453 | A1 * | 8/2005 | Sano | B65H 7/125 271/262 |
| 2016/0114994 | A1 * | 4/2016 | Fukusaka | G03G 15/703 271/3.15 |

* cited by examiner

SHEET CONVEYER DEVICE

CROSS REFERENCE TO RELATED APPLICATION

This application claims priority from Japanese Patent Application No. 2014-248222, filed on Dec. 8, 2014, the entire subject matter of which is incorporated herein by reference.

BACKGROUND

Technical Field

An aspect of the disclosure relates to a sheet conveyer device.

Related Art

A device having an ultrasonic sensor to detect multiple feeding of sheets is known. The multiple feed detectable ultrasonic sensor may be used in, for example, a sheet conveyer. For example, signals indicating ultrasonic waves, which are transmitted through sheets and received in the sensor, may be amplified, and an integral of the amplified signals may be compared with a threshold value to detect multiple feeding of the sheets.

The sheet conveyer may be equipped with an amplifier unit and a determination unit for determining multiple feed of sheets, and with another amplifier unit and another determination unit for determining presence or absence of a sheet in a predetermined position of the sheet conveyer. The sheet conveyer may amplify signals indicating received ultrasonic waves by an amplification rate prepared for the multiple feed determination and compare an integral of the amplified signals with a threshold value prepared for multiple feed determination to determine multiple feeding of sheets. The sheet conveyer may further amplify the signals indicating the received ultrasonic waves by an amplification rate prepared for the sheet-presence determination and compare an integral of the amplified signals with a threshold value prepared for a sheet presence-determination to determine presence or absence of the sheet.

SUMMARY

The above-mentioned sheet conveyer may thus require a complicated configuration of the plurality of units in order to determine a condition of the sheet being fed. For example, the amplifier units, one for determining multiple feed of sheets and another for determining presence of the sheet, may be required. Meanwhile, the complicated configuration of the devices may increase a manufacturing cost and a volume of the sheet conveyer.

An aspect of the present disclosure is advantageous in that a sheet conveyer, in which a condition of sheets being conveyed may be determined by a less complicated configuration, is provided.

According to an aspect of the disclosure, a sheet conveyer device is provided. The sheet conveyer device includes a transmitter arranged on a conveyer path to face a first side of a sheet being conveyed in the conveyer path, the transmitter being configured to transmit ultrasonic waves; a receiver arranged on the conveyer path to face a second side of the sheet being conveyed in the conveyer path, the receiver being configured to receive the ultrasonic waves; a measurement unit configured to measure an intensity of the ultrasonic waves received in the receiver; and a determination unit configured to determine a condition of a range in the conveyer path between the transmitter and the receiver among a first condition, in which no sheet is present in the range, a second condition, in which a single sheet is present in the range, and a third condition, in which a plurality of sheets are present in the range in a layer, based on intensities of the ultrasonic waves measured by the measurement unit in a plurality of periods separately after transmission of the ultrasonic waves from the transmitter.

BRIEF DESCRIPTION OF THE ACCOMPANYING DRAWINGS

DETAILED DESCRIPTION

Figure 1:
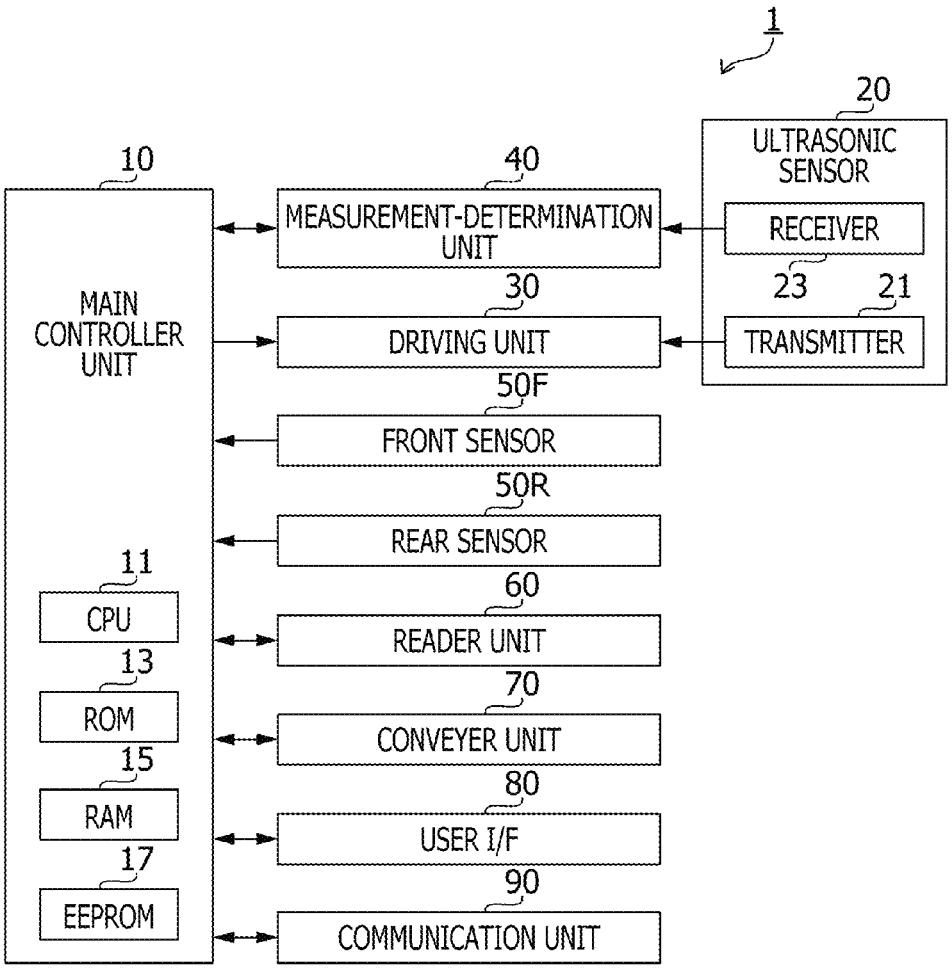
FIG. 1 is a block diagram to illustrate a configuration of an image reading apparatus according to an embodiment of the present disclosure.

Hereinafter, an image reading apparatus 1 as an exemplary embodiment of an image reader according to the disclosure will be described with reference to the accompanying drawings. The image reading apparatus 1 may be a scanner having an auto-document feeder (ADF) and include, as shown in FIGS. 1 and 2, a main controller unit 10, an ultrasonic sensor 20, a driving unit 30, a measurement determination unit 40, a front sensor 50F, a rear sensor 50R, a reader unit 60, a conveyer unit 70, a user interface (I/F) 80, and a communication unit 90.

The main controller unit 10 includes a central processing unit (CPU) 11, a read-only memory (ROM) 13, a random-access memory (RAM) 15, and an electrically erasable programmable read-only memory (EEPROM) 17. The CPU 11 may process various types of data and execute operations in accordance with programs that are stored in, for example, the ROM 13 to control behaviors of the image reading apparatus 1. The RAM 15 may be used as a work area for the CPU 11 to run the programs therein. The EEPROM 17 is a non-volatile memory, in which data may be electrically writable and erasable, to store various types of configuration data. In the following description, some of operations to be executed by the main controller unit 10 will be explained, and it is noted that the operations may be implemented by the CPU 11 executing steps and processes in accordance with the programs stored in the ROM 13.

Figure 2:
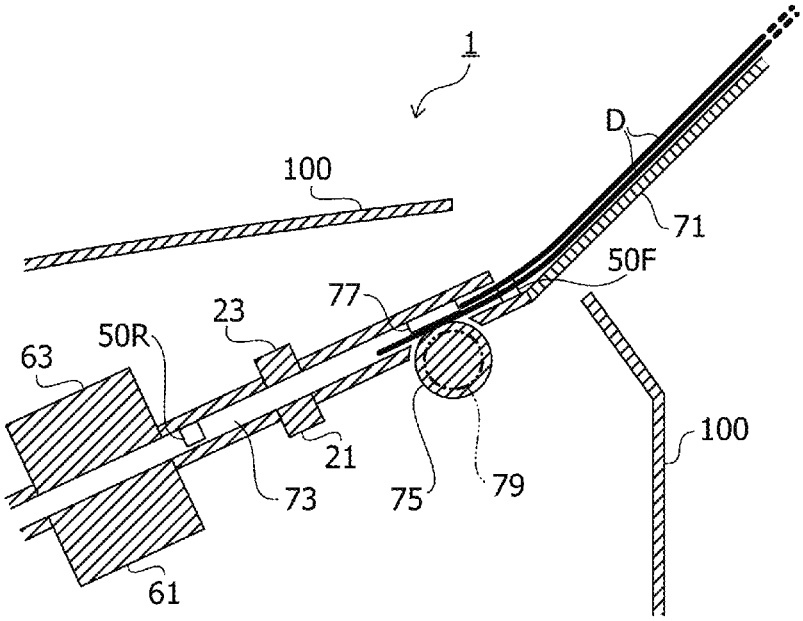
FIG. 2 is an illustrative cross-sectional view of a conveyer path and a neighboring area in the image reading apparatus according to the embodiment of the present disclosure.
Figure 3:
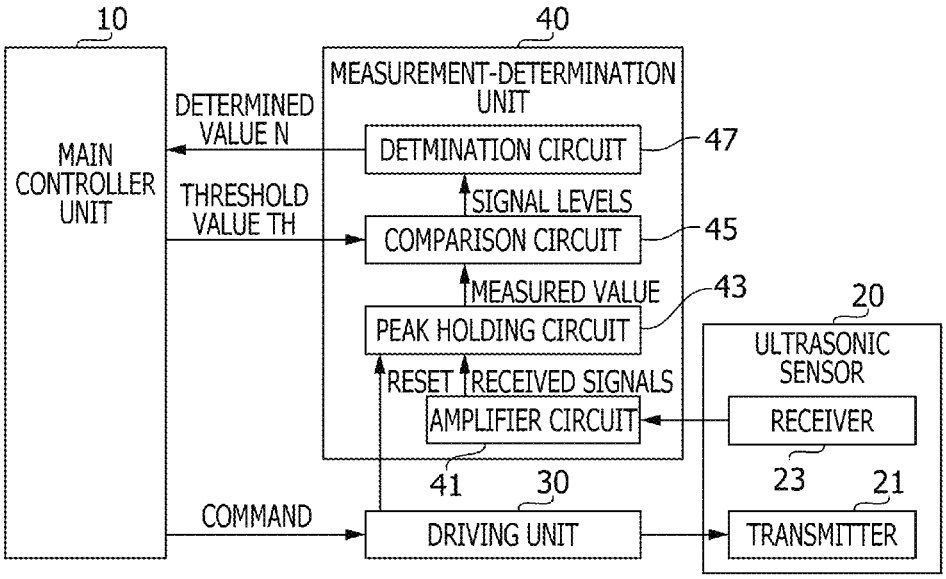
FIG. 3 is a block diagram to illustrate a configuration of a measurement determination unit in the image reading apparatus according to the embodiment of the present disclosure.

The ultrasonic sensor 20 includes, as shown in FIGS. 1-3, a transmitter 21 and a receiver 23. The ultrasonic sensor 20 is disposed on a conveyer path 73, in which an original document D is conveyed, in a chassis 100 of the image reading apparatus 1. The original document D may include one or more sheets. The ultrasonic sensor 20 is used to detect an error occurred in the original document D while the original document D to be read is conveyed from a feeder tray 71 in the conveyer path 73.

The transmitter 21 is arranged on the conveyer path 73 to face one side of the original document D. The transmitter 21 is driven by a driving unit 30 to transmit ultrasonic waves at the receiver 23. The driving unit 30 may receive a driving command from the main controller unit 10 and input burst waves, which are in a driving waveform shown in FIG. 4, Section I, in the transmitter 21 so that the transmitter 21 may output ultrasonic waves according to the driving command. Thus, the transmitter 21 converts the burst waves being electric signals, which are input from the driving unit 30, into the ultrasonic waves and outputs the ultrasonic waves at the receiver 23.

The receiver 23 is arranged on the conveyer path 73 to face the other side of the original document D opposite from the transmitter 21. The receiver 23 may receive the ultrasonic waves transmitted from the transmitter 21 and input electrical signals indicating electrical voltages corresponding to intensities of the received ultrasonic waves in the measurement determination unit 40.

The measurement determination unit 40 may determine a condition of a sensible range, with regard to the original document D, between the transmitter 21 and the receiver 23 in the conveyer path 73. The measurement determination unit 40 may determine the condition of the sensible range among a first condition, in which the original document D is absent at the sensible range, a second condition, in which a sheet of original document D is present at the sensible range, and a third condition, in which a plurality of sheets of original document D are present at the sensible range, and input the determined condition in the main controller unit 10. In the following description, the first, second, and third conditions may be represented by variables N being 0, 1, and 2 respectively. In other words, the determined condition to be input in the main controller unit 10 by the measurement determination unit 40 may be represented by one of the variables N 0, 1, and 2. In the following description, the variables N may be referred to as a determined value N.

The first condition refers to a condition, in which zero (0) sheet of original document D is present in the sensible range. The second condition refers to a condition, in which one (1) sheet of original document D is present in the sensible range. The third condition refers to a condition, in which two (2) or more sheets of original document D are present in the sensible range. Therefore, the determined value N may represent a quantity of sheets in the original document D present in the sensible range.

The front sensor 50F is, as shown in FIG. 2, disposed in a position between the feeder tray 71 and the conveyer path 73 which is and continuous from the feeder tray 71. The front sensor 50F may detect the original document D placed on the feeder tray 71 and input signals indicating the detection in the main unit 10. While presence of the original document D is detected, the front sensor 50F inputs "on" signals in the main controller unit 10.

The rear sensor 50R is, as shown in FIG. 2, disposed downstream from the ultrasonic sensor 20 including the transmitter 21 and the receiver 23, and upstream from a readable position along the conveyer path 73 with regard to a conveying direction to convey the original document D. The readable position is a position, in which images on the original document D are read by line sensors 61, 63. The rear sensor 50R may detect the original sheet B being conveyed toward the readable position and input detecting signals in the main unit 10. While presence of the original document D is detected, the rear sensor 50R inputs "on" signals in the main controller unit 10.

A reader unit 60 may read an image of the original document D passing through the readable position in accordance with a command from the main controller unit 10 and input image data representing the read images of the one and the other sides of the original document D in the main controller unit 10. The reader unit 60 may include the line sensors 61, 63, which are disposed downstream from the rear sensor 50R along the conveyer path 73. The readable position, in which the images of the original document D are read, coincide with the positions of the line sensors 61, 63 on the conveyer path 73.

The line sensors 61, 63 may include, for example, contact image sensors (CIS). The reader unit 60 may use the line sensor 61 to optically read the one side of the original document D and the line sensor 63 to optically read the other side of the original document D to generate image data representing the images on the one and the other sides of the original document D to provide to the main controller unit 10.

A conveyer unit 70 may be driven in accordance with a command from the main controller unit 10 to separate sheets of original document D placed on the feeder tray 71 one from the other and convey the sheets downstream one by one along the conveyer path 73. The feeder tray 71 is disposed upstream from the conveyer path 73 with regard to the conveying direction. The conveyer unit 70 may include, as shown in FIG. 2, the feeder tray 71 and the conveyer path 73 continuous from the feeder tray 71.

The conveyer unit 70 further includes a separator roller 75, a separator piece 77, and a motor (not shown). The conveyer unit 70 may be driven in accordance with the command from the main controller unit 10 to drive the motor and rotate the separator roller 75 so that one of the sheets in the original document D placed on the feeder tray 71 may be separated and conveyed downstream in the conveyer path 73.

The separator piece 77 is arranged to face with the separator roller 75 across the conveyer path 73 so that one of the sheets in the original document D placed on the feeder tray 71 may be separated between the separator roller 75 and the separator piece 77 by rotation of the separator roller 75 and conveyed downstream. In a few occasions, however, two or more sheets of original document D may be conveyed at once in a layer. Such an event may be called as multiple feeding and may be considered as a conveyance error of the original document D.

The conveyer unit 70 further includes a rotary encoder 79 disposed on a rotation shaft of the separator roller 75. The rotary encoder 79 may output encoder signals, which correspond to a rotating amount of the separator roller 75. The conveyer unit 70 may measure the rotating amount of the separator roller 75 based on the encoder signals and input the measured rotating amount in the main controller unit 10.

The user interface 80 may include a display device (not shown) and a speaker to output visual information and audio indication to a user. The user interface 80 may further include an operation unit (e.g., a touch-sensitive panel), which may be operated by the user.

The communication unit 90 may be used to communicate with an external device (not shown). The communication unit 90 may be controlled by the main controller unit 10 and provide, for example, image data representing the read images of the original document D to the main controller unit 10.

Next, a configuration and operations to detect the conveyance error of the original document D will be described with reference to FIGS. 3 and 4. As shown in FIG. 3, the measurement determination unit 40 includes an amplifier circuit 41, a peak holding circuit 43, a comparison circuit 45, and a determination circuit 47. The amplifier circuit 41 may amplify signals of the ultrasonic waves input from the receiver 23 that received the ultrasonic waves. The amplified signals are input from the amplifier circuit 41 in the peak holding circuit 43.

The peak holding circuit 43 may, similarly to a known peak holding circuit, maintain a voltage of the input signals at a peak value. In the following description, the peak voltage maintained in the peak holding circuit 43 will be referred to as a peak-held value.

The peak holding circuit 43 may be configured not to maintain the peak voltage when a resetting signal input from the driving unit 30 indicates "on." Therefore, when the resetting signal indicates on, the peak holding circuit 43 may indicate a peak-held value being zero (0).

On the other hand, when the resetting signal from the driving unit 30 indicates "off," the peak holding circuit 43 may maintain the voltage of the input signals at the peak. Therefore, with regard to the amplified signals of the ultrasonic waves input from the amplifier circuit 43, the peak holding circuit 43 may switch to maintain the peak voltage of the received signals at a timing when the resetting signals are switched from "on" to "off." The peak-held value indicating the peak voltage may correspond to a measured intensity of the received ultrasonic wave.

The comparison circuit 45 may compare the peak-held value indicated by the peak holding circuit 43 with a threshold value TH set by the main controller unit 10 and determine the intensity of the received ultrasonic waves to be either high or low. For example, when the peak-held value is higher than the threshold value TH, the comparison circuit 45 may determine that the intensity of the received ultrasonic waves is at a high level, and when the peak-held value is lower than or equal to the threshold value TH, the comparison circuit 45 may determine that the intensity of the received ultrasonic waves is at a low level. The comparison circuit 45 may input the determined level of the intensity in the determination circuit 47 as a signal level of the received ultrasonic waves.

In the present embodiment, after transmission of the ultrasonic waves from the transmitter 21, the resetting signal to be input in the peak holding circuit 43 is switched off twice, during a measurement period M1 and a measurement period M2. Section I in FIG. 4 is a graph indicating a waveform of a burst wave to be input as a driving wave from the driving unit 30 to the transmitter 21 along a horizontal axis extending on a timeline. Section II in FIG. 4 is a graph indicating a waveform of the resetting signals, which are switched on and off and input from the driving unit 30 in the peak holding circuit 43, along a horizontal axis extending on the same timeline as the timeline of the driving wave shown in Section I.

Thus, according to the present embodiment, after transmission of the ultrasonic waves, the voltage is maintained at the peak during the first measurement period M1 and the second measurement period M2 by the peak holding circuit 43. In the first measurement period M1, an intensity of the received signals is measured firstly, and the peak-held value corresponding to the intensity of the received ultrasonic waves in the period is provided to the comparison circuit 45. Further, in the second measurement period M2, which is later than the first measurement period M1, an intensity of the received signals is measured secondly, separately from the intensity measured in the first measurement period M1, and the peak-held value corresponding to the intensity of the received ultrasonic waves in the period is provided to the comparison circuit 45.

The comparison circuit 45 may compare the peak-held value with the threshold value TH in each of the first measurement period M1 and the second measurement period M2 and input the determined signal levels of the received ultrasonic waves in the determination circuit 47.

In the following description, the signal level during the first measurement period M1 may be referred to as a first signal level, and the signal level during the second measurement period M2 may be referred to as a second signal level. The first measurement period M1 is a period lasting for a predetermined length from a predetermined timing T1. The second measurement period M2 is a period lasting for a predetermine length from another predetermined timing T2. The timings T1, T2 will be described later in detail.

The determination circuit 47 determines a condition of the sensible range in the conveyer path 73 among a first condition, in which N is 0, a second condition, in which N is 1, and a third condition, in which N is 2, based on the signal levels including the first and the second signal levels received from the comparison circuit 45.

For example, the determination circuit 47 may determine that the sensible range is in the first condition, in which the determined value N is 0, when the first signal level and the second signal level both indicate high. When the first signal level indicates high and the second signal level indicates low, the determination circuit 47 may determine that the sensible range is in the second condition, in which the determined value N is 1. When the first signal level and the second signal level both indicate low, the determination circuit 47 may determine that the sensible range is in the third condition, in which the determined value N is 2. The determination circuit 47 may output the determined value N to the main controller unit 10.

The waveforms of the ultrasonic waves will be described herein below. Section III in FIG. 4 is a graph of a waveform of the received ultrasonic waves, which are transmitted from the transmitter 21 according to the waveform of the driving waves illustrated in Section I, FIG. 4, and are received by the receiver 23 when the sensible range is in the first condition. The waveform corresponds to the received signals input in the peak holding circuit 43. The horizontal axes in Sections I through VIII in FIG. 4 all extend along the same timeline.

Figure 4:
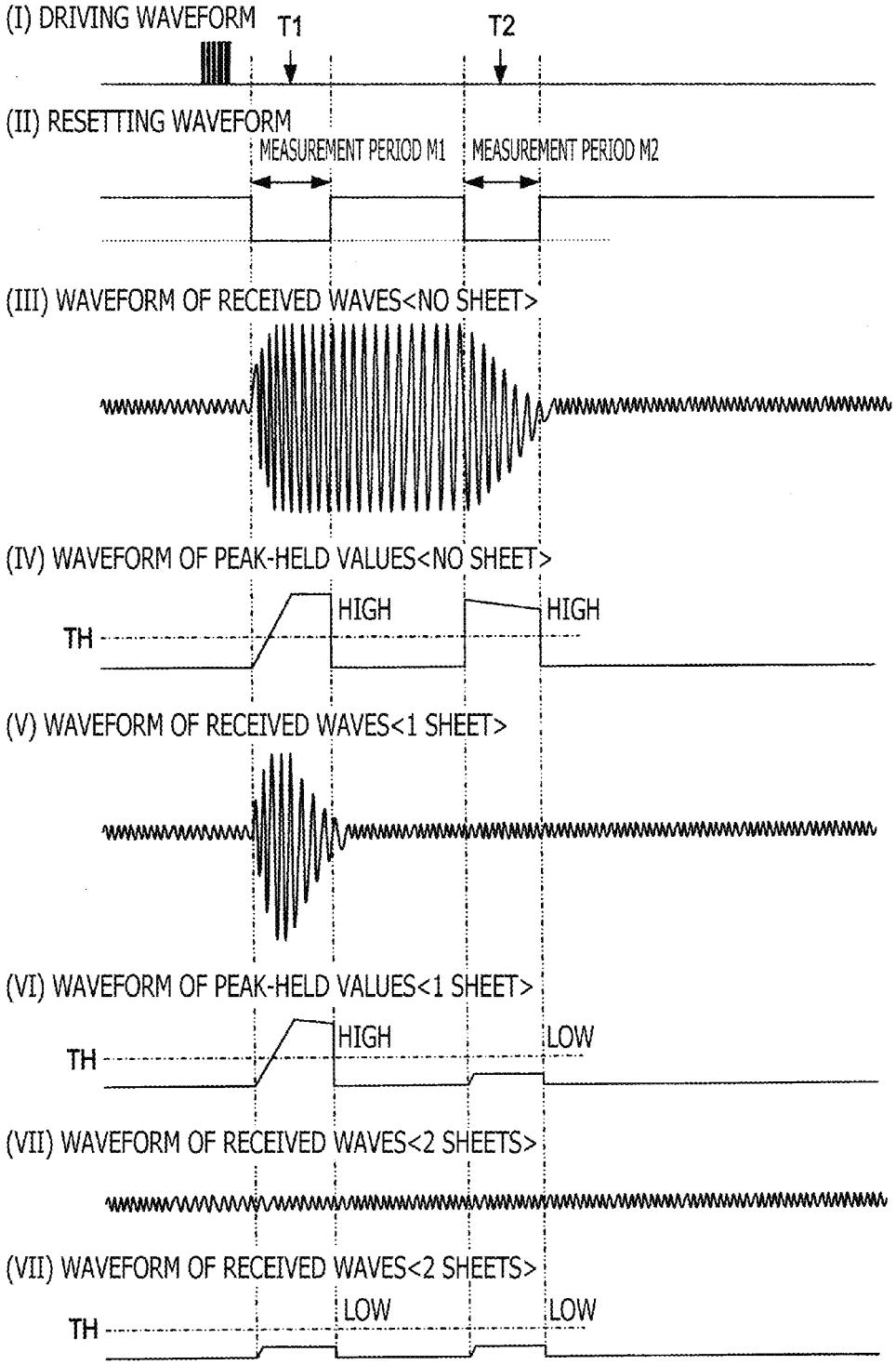
FIG. 4 shows diagrams to illustrate waveforms, including waveforms of received ultrasonic waves along horizontal axes representing a time line, in the image reading apparatus according to the embodiment of the present disclosure.

Section IV in FIG. 4 is a graph of a waveform of the peak-held value when the received and amplified signals corresponding to the waveform shown in Section III are input in the peak holding circuit 43, along the horizontal axis extending on the same timeline. The waveform of the peak-held value shown in Section IV is observed when the resetting signals are switched on or off in the waveform illustrated in Section II, FIG. 4.

As shown in Section IV, FIG. 4, the peak-held value moderately descends during the second measurement period M2. The descent of the peak-held value may be caused by electrical charges accumulated in a condenser leaking therefrom and the voltage dropping at both ends of the condenser. In other words, similarly to the known peak holding circuit, the peak holding circuit 43 may not maintain the voltage steadily at the peak for a longer period, and the peak-held value may decline over the time period.

Section V in FIG. 4 is a graph of a waveform of the ultrasonic waves received in the receiver 23 when the sensible range is in the second condition along the horizontal axis extending on the same time line. Section VI in FIG. 4 is a graph of a waveform of the peak-held value when the received and amplified signals corresponding to the waveform shown in Section V are input in the peak holding circuit 43 along the horizontal axis extending on the same time line.

Section VII in FIG. 4 is a graph of a waveform of the ultrasonic waves received in the receiver 23 when the sensible range is in the third condition along the horizontal line extending on the same timeline. Section VIII in FIG. 4 is a graph of a waveform of the peak-held value when the received and amplified signals corresponding to the waveform shown in Section VII are input in the peak holding circuit 43 along the horizontal axis extending on the same time line.

As seen from the waveforms shown in Sections III, V, and VII, the received ultrasonic waves indicate a highest intensity or a largest amount of amplitude when the sensible range being a part of a transmission path for the ultrasonic waves from the transmitter 21 to the receiver is at the first condition, in which no original document D to interfere with the ultrasonic waves is present in the sensible range. In the first condition where no original document D is present, it may require a longer period of time until a reverberant component of the ultrasonic waves attenuates; therefore, the waveform may indicate the highest intensity for the longer time.

Therefore, the intensity of the received signals, i.e., the peak-held value, measured in the first measurement period M1 tends to be the highest when the sensible range is in the first condition within the first, second, and third conditions. The intensity of the received signals measured in the first measurement period M1 tends to be the second to the highest when the sensible range is in the second condition and tends to be the lowest when the sensible range is in the third condition. Meanwhile, an attenuation rate of the reverberant component in the ultrasonic waves may be the highest when the sensible range is in the third condition and the lowest when the sensible range is in the first condition. Therefore, an intensity of the received signals, i.e., the peak-held value, measured in the second measurement period M2 when the sensible range is in the second or the third condition may indicate a smaller value which is smaller than the intensity of the received signals when the sensible range is in the first condition.

While the intensities of the received signals, i.e., the peak-held values, in the first and second measurement periods M1, M2 may have the tendency described above, in the present embodiment, the condition of the sensible range is determined based on the combination of the first signal level and the second signal level.

In order to make the determination, the threshold value TH is set at a value, by which the first signal level is determined to be at the high level when the sensible range is either in the first condition or the second condition, and by which the first signal level is determined to be at the low level when the sensible range is in the third condition. Further, the threshold value TH is set at a value, by which the second signal level is determined to be the high level when the sensible range is in the first condition, and by which the second signal level is determined to be the low level when the sensible range is either in the second condition or the third condition.

In the present embodiment, the first signal level and the second signal level are determined based on the same threshold value TH. However, a threshold value to be referred to in order to determine the first signal level may be different from a threshold value to be referred to in order to determine the second signal level. If the first signal level and the second signal level are determined based on the same threshold value TH, meanwhile, it may not be necessary to switch the threshold values, and a process and a configuration to make the determination may be simplified.

An example of a method to set the threshold value TH, when a common threshold value TH is used to determine the first signal level and the second signal level, the first measurement period M1, and the second measurement period M2, will be described below. When the common threshold value TH is used, it may be preferable that the first measurement period M1 and the second measurement period M2 are set in a such relationship that the intensity of the received signals in the second measurement period M2 when the sensible range is in the first condition should indicate a vale in a substantially same range as the intensity of the received signals in the first measurement period M1 when the sensible range is in the second condition. Further, for accurate determination, it may be preferable that the first measurement period M1 should have a substantial a length, in which the intensity of the received ultrasonic waves should indicate a highest degree after the transmission.

For example, a designer of the image reading apparatus 1 may set the first measurement period M1, the second measurement period M2, and the threshold value TH according to the following steps.

In a first step, the designer may place a sheet of original document D in the sensible range, which is in the range between the transmitter 21 and the receiver 23, to create the second condition. In a second step, the designer may observe a peak-held value indicated by the peak holding circuit 43 while the resetting signal to be input in the peak holding circuit 43 is maintained off and the transmitter 21 transmits ultrasonic waves.

Figure 5:
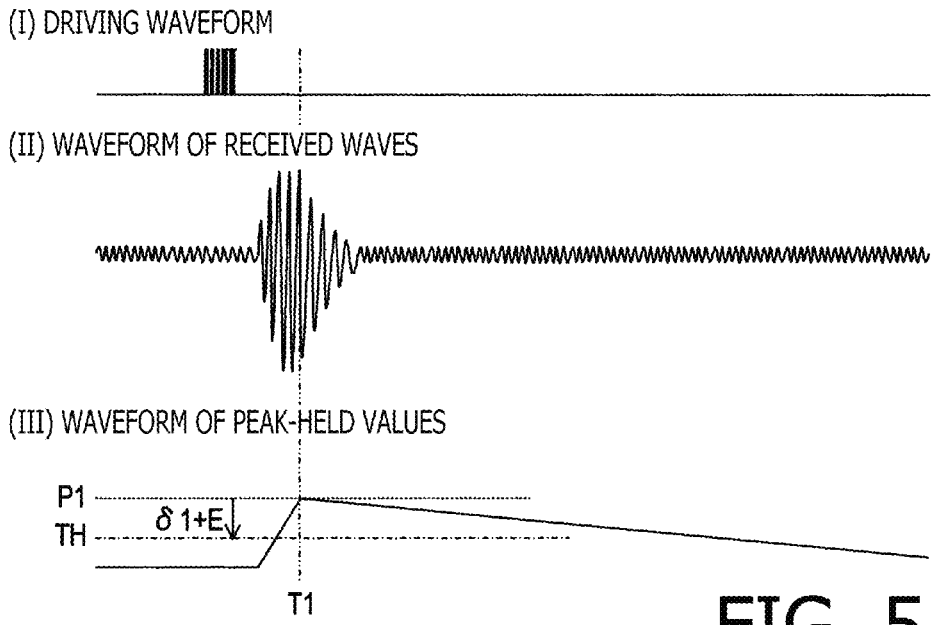
FIG. 5 shows diagrams to illustrate a method to determine a first measurement period and a threshold value in the image reading apparatus according to the embodiment of the present disclosure.

Section III in FIG. 5 illustrates a graph of a waveform of the peak-held value to be observed in the second step. Section I in FIG. 5 illustrates the driving waveform of the ultrasonic waves, which are in the same waveform as the driving waveform shown in Section I, FIG. 4, along the horizontal axis extending on the same timeline. Section II in FIG. 5 illustrates a graph of a waveform of the received ultrasonic waves when the sensible range is in the second condition along the horizontal axis extending on the same timeline. The horizontal axes in Sections I-III in FIG. 5 all extend on the same timeline.

In a third step, the designer may determine a timing T1, which is determined with reference to the timing of transmission of the ultrasonic waves, and at which the peak-held value indicated a maximum value in the second step, based on the waveform of the peak-held value observed in the second step (see Section III, FIG. 5). Further, the designer may specify a peak-held value P1 at the timing T1.

In a fourth step, the designer may remove the sheet of original document D from the sensible range between the transmitter 21 and the receiver 23 to create the first condition. In a fifth step, the designer may observe a peak-held value indicated by the peak holding circuit 43 while the resetting signal to be input in the peak holding circuit 43 is maintained off and the transmitter 21 transmits ultrasonic waves.

Figure 6:
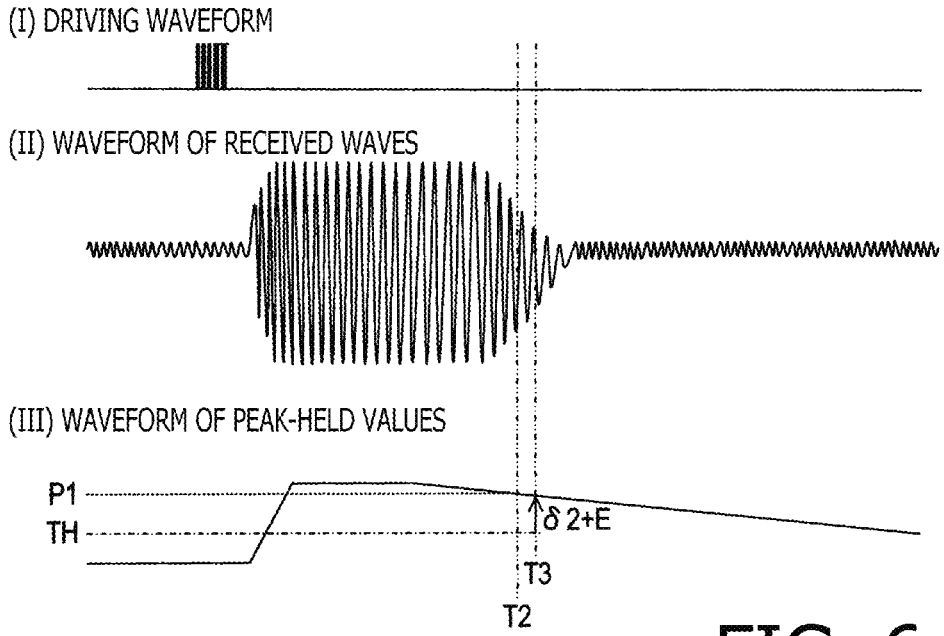
FIG. 6 shows diagrams to illustrate a method to determine a second measurement period and a threshold value in the image reading apparatus according to the embodiment of the present disclosure.

Section III in FIG. 6 illustrates a graph of a waveform of the peak-held value to be observed in the fifth step. Section I in FIG. 6 illustrates the driving waveform of the ultrasonic waves, which is the same waveform as the driving waveform shown in Section I, FIG. 4, along the horizontal axis extending on the same timeline. Section II in FIG. 6 illustrates a graph of a waveform of the received ultrasonic waves when the sensible range is in the first condition along the horizontal axis extending on the same timeline. The horizontal axes in Sections I-III in FIG. 6 all extend on the same timeline.

In a sixth step, the designer may determine a timing T2, which is determined with reference to the timing of transmission of the ultrasonic waves, and at which the peak-held value indicated the same value as the peak-held value P1 at the timing T1 determined in the third step.

In a seventh step, the designer may calculate a fluctuant range M for the peak-held value P1 in consideration of temperature and humidity fluctuation, and fluctuation due to aged deterioration of the ultrasonic sensor 20. Thereafter, the designer may determine the threshold value TH at a value (P1−δ1−E), which is lower than the peak-held value P1 for an amount (δ1+E), while the amount (δ1+E) is a sum of the fluctuant range M and a margin E. Further, the designer may determine a predetermined length of period with reference to the timing T1 to be the first measurement period M1 and a predetermined length of period with reference to the timing T2 to be the second measurement period M2. For example, the first measurement period M1 and the second measurement period M2 may be centered at the timing T1 and the timing T2, respectively.

Thus, the designer may follow the first through seventh steps to set the first and second measurement periods M1, M2, and the threshold value TH so that the image reading apparatus 1, in which the measurement determination unit 40 may determine the condition in the sensible range based on the same threshold value TH, may be provided.

Meanwhile, the peak-held value P1 at the timing T1 may further fluctuate by a type (e.g., a sheet type) of the original document D. Therefore, the threshold value TH (P1−δ1−E) may be determined by calculating the fluctuant range δ1 for the peak-held value P1 in consideration of temperature and humidity fluctuation, fluctuation due to the aged deterioration of the ultrasonic sensor 20, and additionally in consideration of fluctuation due to the type of the original document D, and subtracting the fluctuant range δ1 and the margin E from the peak-held value P1.

In this case, the second measurement period M2 may alternately be determined in the following method. That is, a threshold value TH (P1−δ1−E) may be determined in consideration of the fluctuation due to the type of the original document. Thereafter, with reference to the determined threshold TH (P1−δ1−E), a timing T3, at which the peak-held value indicates a value (P1−δ1+δ2) may be determined based on the waveform of the peak-held value observed in the fifth step. The value (P1−δ1+δ2) is higher than the threshold value TH (P1−δ1−E) for a sum (δ2+E) of a fluctuant range δ2 and the margin E. In this regard, the fluctuant range δ2 is a fluctuant range for the peak-held value in consideration of the temperature and humidity fluctuation and the fluctuation due to the aged deterioration of the ultrasonic sensor 20 when no original document D is present in the sensible range.

Following the above method, the first measurement period M1 and the second measurement period M2, in which the intensity of the received ultrasonic waves in the second measurement period M2 when the sensible range is in the first condition and the intensity of the received ultrasonic waves in the first measurement period M1 when the sensible range is in the second condition may indicate the values in the substantially same range, may be determined so that the condition of the sensible range may be determined with reference to the common threshold value TH.

Figure 7:
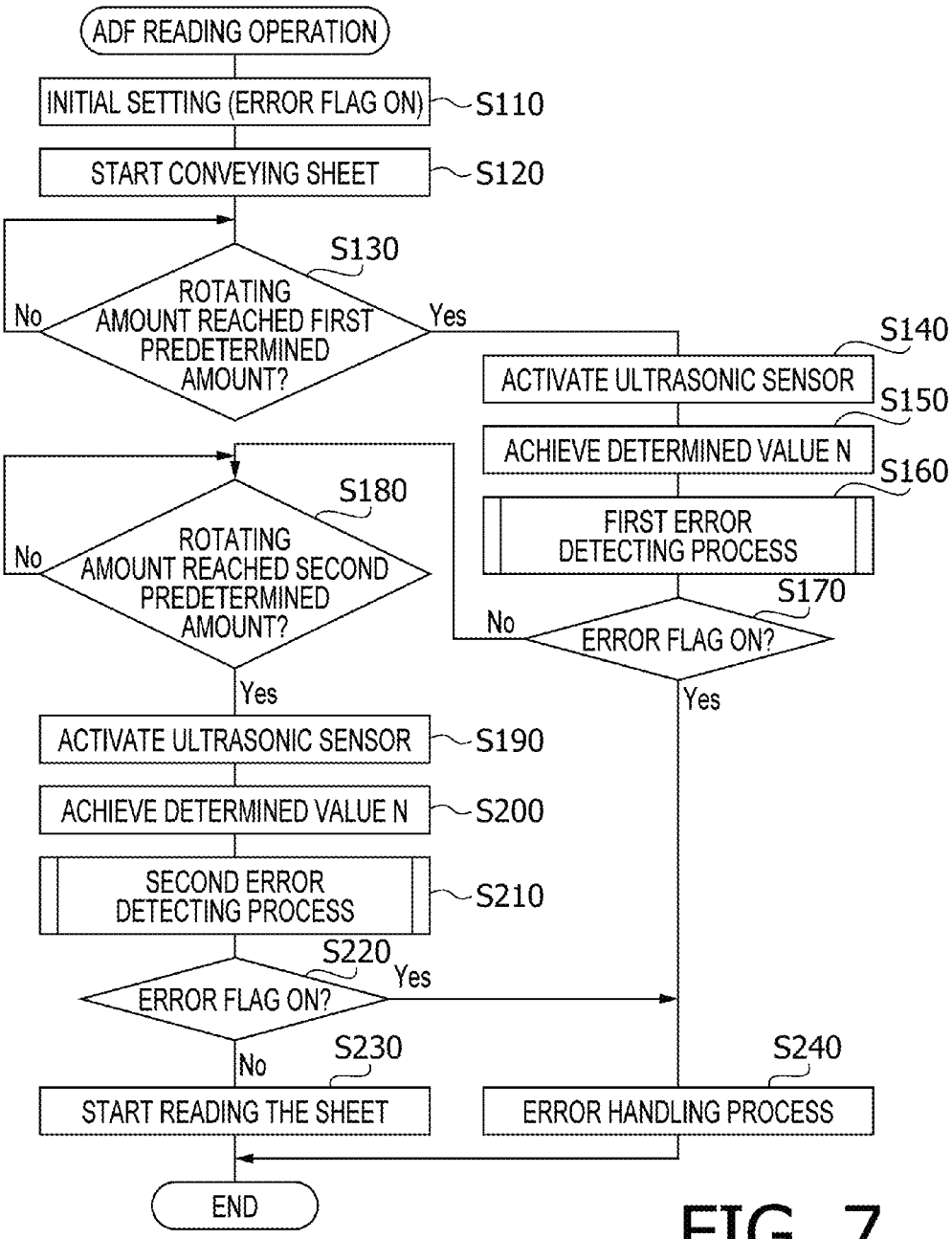
FIG. 7 is a flowchart to illustrate an ADF reading operation to be executed by a main controller unit in the image reading apparatus according to the embodiment of the present disclosure.
Figure 8:
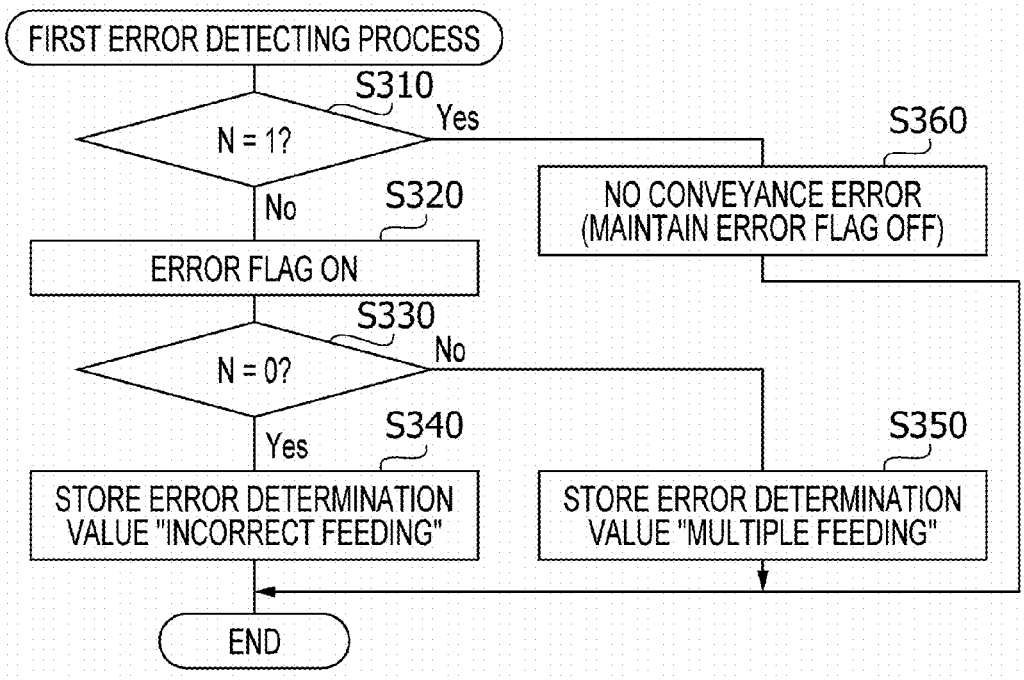
FIG. 8 is a flowchart to illustrate a first error detecting process to be executed by the main controller unit in the image reading apparatus according to the embodiment of the present disclosure.
Figure 9:
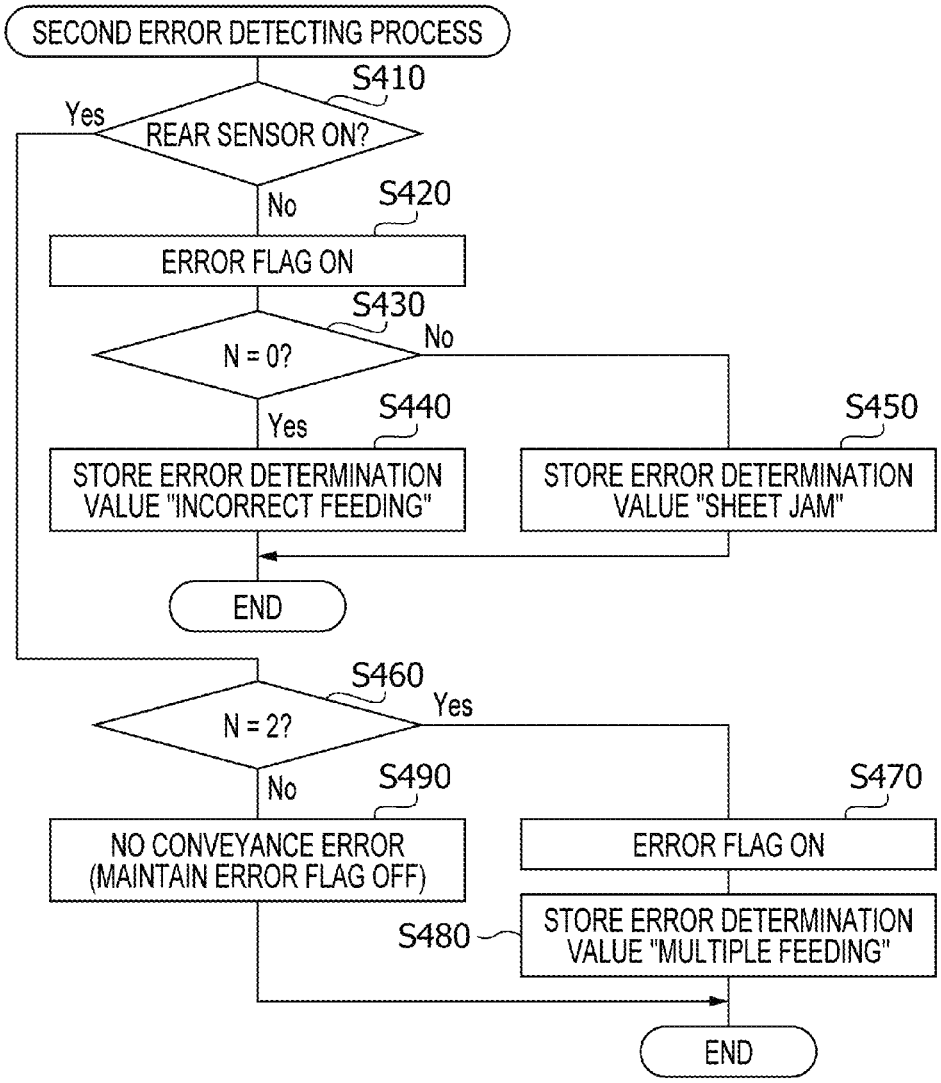
FIG. 9 is a flowchart to illustrate a second error detecting process to be executed in the main controller unit in the image reading apparatus according to the embodiment of the present disclosure.

Next, an ADF reading operation, which is executed by the main controller unit 10 when a reading command from the user is entered through the user interface 80 or through the communication unit 90 from the external device, with reference to FIGS. 7-9. In the ADF reading operation, the ultrasonic sensor 20 is activated and may detect a conveyance error in the original document D. The main controller unit 10 may repeat the ADF reading operation based on the signals input from the front sensor 50F until no sheet of original document D is left on the feeder tray 71.

As the ADF reading operation starts, in S110, the main controller unit 10 executes an initial setup process, in which an initial configuration required in the operation for the following steps are set. The initial setup process may include a procedure to reset an error flag off. The error flag will be described later in detail.

In S120, the main controller unit 10 inputs a command in the conveyer unit 70 to separate a sheet from other sheets of original document D on the feeder tray 71 and convey the separated sheet downstream. In S130, the main controller unit 10 determines whether a rotating amount of the separator roller 75 reached a first predetermined amount. Thus, based on the rotating amount of the separator roller 75, the main controller unit 10 may determine that the sheet of original document reached the sensible range between the transmitter 21 and the receiver 23. The first predetermined amount may be a rotating amount, which is required for the sheet to be conveyed by the separator roller 75 to reach the sensible range without an error.

When the rotating amount of the separator roller 75 reached the first predetermined amount (S130: YES), in S140, the main controller unit 10 inputs a driving command in the driving unit 30 to drive the driving unit 30 and activate the ultrasonic sensor 20.

According to the driving command, the driving unit 30 inputs the burst waves as illustrated in Section I in FIG. 4 in the transmitter 21 to manipulate the transmitter 21 to transmit the ultrasonic waves. Further, the driving unit 30 inputs a resetting signal in the peak holding circuit 43 so that the resetting signal is switched off during the first measurement period M1 and in the second measurement period M2, which are illustrated in Section II in FIG. 4 and determined with reference to the timing of transmission of the ultrasonic waves.

The measurement determination unit 40, in synchronization with the resetting signals, compares the peak-held value during the first measurement period M1 with the threshold value TH and the peak-held value during the second measurement period M2 with the threshold value TH. Further, the measurement determination unit 40 determines the condition in the sensible range among the first, second, and third conditions based on the combination of the first signal level and the second signal level achieved in the comparison.

Thereafter, the measurement determination unit 40 inputs the determined value N in the main controller unit 10.

Following S140, in S150, the main controller unit 10 receives the determined value N from the measurement determination unit 40. Further, in S160, the main controller unit 10 executes a first error detecting process (FIG. 8) based on the determined value N.

As the first error detecting process starts, as shown in FIG. 8, in S310, the main controller unit 10 determines whether the determined value N is 1. If the determined value is 1 (S310: YES), in S360, the main controller unit 10 determines that no conveyance error occurred in the original document D. The main controller unit 10 maintains the error flag off and ends the first error detecting process.

On the other hand, if the determined value N is not 1 (S310: NO), in S320, the main controller unit 10 determines that a conveyance error occurred in the original document D and switches the error flag on.

Further, in S330, if the determined value N is 0 (zero) (S330: YES), the main controller unit 10 determines that the type of the conveyer error is incorrect feeding of the sheets in the original document D. Therefore, in S340, the main controller unit 10 stores an error determination value indicating the incorrect feeding in the RAM 15. If the determined value N is 2 (S330: NO), in S350, the main controller unit 10 determines that the type of the conveyer error is multiple feeding of the sheets. Therefore, in S350, the main controller unit 10 stores an error determination value indicating the multiple feeding in the RAM 15 and ends the first error detecting process.

Following the first error detecting process in S160 (FIG. 7), in S170, the main controller unit 10 determines whether the error flag is on. If the error flag is on (S170: YES), the main controller unit 10 proceeds to S240. If the error flag is off (S170: NO), the main controller unit 10 proceeds to S180.

In S240, the main controller unit 10 executes an error handling process, in which the error of the conveyance error in the original document D may be treated. In the error handling process, the main controller unit 10 may display a message to alert the occurrence and the type of the conveyance error on the display device in the user interface 80 in accordance with an error determination value stored in the RAM 15. The error handling process may include, further, a procedure to abort the conveyance of the original document D by the conveyer unit 70.

Following the error handling process, the main controller unit 10 ends the ADF reading operation. In this regard, however, if S240 is executed after the affirmative determination in S170 (S170: YES), the main controller unit 10 may display the error message on the display device in the error handling process and thereafter proceed to S180 without aborting the conveyance of the original document D or ending the ADF reading operation.

In S180, the main controller unit 10 determines whether the rotating amount of the separator roller 75, since the separator roller 75 started rotating upon input of the command to the conveyer unit 70 in S120, reached a second predetermined amount. Thereby, the main controller unit 10 may determine whether the sheet of original document D reached the position of the rear sensor 50R in the conveyer path 73. The second predetermined amount may be a rotating amount, which is required for the sheet to be conveyed by the separator roller 75 to reach the position of the rear sensor 50R without an error.

When the rotating amount of the separator roller 75 reached the second predetermined amount (S180: YES), in S190, similarly to S140, the main controller unit 10 inputs a driving command in the driving unit 30 to drive the driving unit 30 and activate the ultrasonic sensor 20. According to the driving command, the main controller unit 10 manipulates the transmitter 21 to transmit the ultrasonic waves. Meanwhile, the measurement determination unit 40 is driven to measure the intensities of the received ultrasonic waves in the first measurement period M1 and the second measurement period M2 separately and determines the condition of the sensible range based on the first signal level and the second signal level corresponding to the measured intensities.

Following S190, in S200, the main controller unit 10 receives the determined value N from the measurement determination unit 40. Further, in S210, the main controller unit 10 executes a second error detecting process (FIG. 9) based on the determined value N.

As the second error detecting process starts, as shown in FIG. 9, in S410, based on the signals input from the rear sensor 50R, the main controller unit 10 determines whether the rear sensor 50R detects presence of the original document D passing thereby. If the signals input from the rear sensor 50R indicate "on," the main controller unit 10 makes affirmative determination (S410: YES), the main controller unit 10 proceeds to S460. If the signals input from the rear sensor 50R indicate "off," the main controller unit 10 makes negative determination (S410: NO) and proceeds to S420.

In S420, the main controller unit 10 switches the error flag on. Further, if the determination value N is 0 (S430: YES), the main controller unit 10 determines that the type of the conveyer error is incorrect feeding of the sheets in the original document D. Therefore, in S440, the main controller unit 10 stores an error determination value indicating the incorrect feeding in the RAM 15 and ends the second error detecting process.

On the other hand, if the determined value N is either 1 or 2 (S430: NO), in S450, the main controller unit 10 determines that the type of the conveyer error is sheet jam. Therefore, in S450, the main controller unit 10 stores an error determination value indicating the sheet jam in the RAM 15 and ends the second error detecting process.

Following the affirmative determination in S410 (S410: YES), in S460, the main controller unit 10 determines whether the determined value N is 2. If the determined value N is 2 (S460: YES), in S470, the main controller unit 10 switches the error flag on and determines that the type of the conveyer error is multiple feeding of the sheets. Therefore, in S480, the main controller unit 10 stores an error determination value indicating the multiple feeding in the RAM 15 and ends the second error detecting process.

Meanwhile, if the determined value N is 1 (S460: NO), in S490, the main controller unit 10 determines that no conveyance error occurred in the original document D. The main controller unit 10 maintains the error flag off and ends the second error detecting process.

In the flow where the main controller unit 10 proceeds to S460, while the rear sensor 50R detects the sheet of original document D (S410: YES), it may not be likely that the determination value N indicates 0. However, if the main controller unit 10 finds the determined value N being 0 in S460, it may be for example considered as an error in the determined value N, and the main controller unit 10 may proceed to S490. For another example, if the main controller unit 10 finds the determined value N being 0 in S460, the main controller unit 10 may set the error flag on and store an error determination value indicating a sensor error in the RAM 15.

After the second error detecting process, the main controller unit 10 proceeds to S220 (see FIG. 7) to determine whether the error flag is set on. If the error flag is on (S220: YES), the main controller unit 10 proceeds to S240 and executes the error handling process described earlier. Thereafter, the main controller unit 10 ends the ADF reading operation.

If the error flag is off (S220: NO), the operation proceeds to S230. In S230, the main controller unit 10 inputs a command in the reader unit 60 to start reading the sheet of original document D, which is conveyed through the rear sensor 50R and reaches a readable position.

Thus, when no conveyance error is occurring in the sheet of original document D, the sheet is conveyed continuously while the reader unit 60 reads images on the both sides of the sheet and generates image data corresponding to the read images. The image data may be, for example, provided to the external device through the communication unit 90.

Optionally or additionally, the main controller unit 10 may activate the ultrasonic sensor 20 periodically after the reader unit 60 starts reading the images and receive the determined value N from the measurement determination unit 40. When the determination value N indicates 2, the main controller unit 10 may determine the type of the conveyance error to be multiple feeding and abort the conveyance of the sheet by the conveyer unit 70.

According to the image reading apparatus 1 described above, the condition of the original document D in the sensible range may be determined by use of the phenomenon that the attenuation rate differs among the conditions of the original document D in the sensible range between the transmitter 21 and the receiver 23. In particular, the condition in the sensible range among the first condition, the second condition, and the third condition, may be determined based on the intensities of the received ultrasonic waves (i.e., the peak-held values) measured at the different timings separately, i.e., in the first and second measurement periods M1, M2, after the transmission of the ultrasonic waves.

Therefore, in the embodiment described above, the condition of conveying the original document D may be determined accurately in the less complicated configuration. Accordingly, incorrect feeding of the sheet, sheet jam, and multiple feeding of sheets may be accurately determined in the less complicated configuration.

In particular, the intensities of the received ultrasonic waves measured by the peak holding circuit 43 in the first and second measurement periods M1, M2 are compared with the threshold value TH to be converted into binary values. In other words, the comparison circuit 45 compares the level of intensity of the received ultrasonic waves measured in the first measurement period M1 with the threshold value TH to determine the first signal level between two levels: high and low. Further, the comparison circuit 45 compares the level of intensity of the received ultrasonic waves measured in the second measurement period M2 with the threshold value TH to determine the second signal level between two levels: high and low.

Thus, the determination circuit 47 may determine the condition of the sensible range among the first, second, and third conditions based on the combination of the first signal level and the second signal level easily and effectively.

Although an example of carrying out the disclosure have been described, those skilled in the art will appreciate that there are numerous variations and permutations of the image reading apparatus that fall within the spirit and scope of the disclosure as set forth in the appended claims. It is to be understood that the subject matter defined in the appended claims is not necessarily limited to the specific features or act described above. Rather, the specific features and acts described above are disclosed as example forms of implementing the claims.

For example, the ADF reading operation may omit a flow between S130 and S170. In other words, in the ADF reading operation, the main controller unit 10 may proceed from S120 to S180.

For another example, the measurement periods to measure the intensities of the received ultrasonic waves may not necessarily be limited to twice, i.e., the first and second measurement periods M1, M2 but the intensities of the received ultrasonic wave may be measured in three (3) or more measurement periods so that the condition of the sensible range may be determined based on the combination of the signal levels measured in the three or more measurement periods.

For another example, the functions, the devices, and/or the units to determine the condition of the sensible range with regard to the sheet being conveyed may not necessarily be applied to an image reading apparatus but may be applied to another electric device that may convey sheets therein. For example, the functions, the devices, and/or the units to determine the condition of the sensible range may be applied to an image forming apparatus (e.g., an inkjet printer), which may convey sheets and form images on the sheets being conveyed.

For another example, the comparison circuit 45 and the determination circuit 47 may not necessarily be installed in the measurement determination unit 40. The measurement determination unit 40 may be replaced with an analog-digital (AD) converter so that the peak-held values may be converted in the AD converter into digital values to be input in the main controller unit 10. In this configuration, the main controller unit 10 may implement the functions of the comparison circuit 45 and the determination circuit 47 by software programs.

For another example, the processes or the behaviors that are conducted by the peak holding circuit 43, the comparison circuit 45, and the determination circuit 47 in the above embodiment may be, either partly or entirely, conducted by the main controller unit 10.

What is claimed is:

1. A sheet conveyer device, comprising:

a transmitter arranged on a conveyer path to face a first side of a sheet being conveyed in the conveyer path, the transmitter being configured to transmit ultrasonic waves;

a receiver arranged on the conveyer path to face a second side of the sheet being conveyed in the conveyer path, the receiver being configured to receive the ultrasonic waves;

a measurement unit configured to measure an intensity of the ultrasonic waves received in the receiver; and a determination unit configured to determine a condition of a range in the conveyer path between the transmitter and the receiver among a first condition, in which an attenuation rate of reverberant component in the transmitted ultrasonic waves is lowest and no sheet is determined to be present in the range, a second condition, in which the attenuation rate of the reverberant component in the transmitted ultrasonic waves is higher than the first condition and a single sheet is determined to be present in the range, and a third condition, in which the attenuation rate of the reverberant component in the transmitted ultrasonic waves is higher than the second condition and a plurality of sheets are determined to be present in the range in a layer, based on intensities of the reverberant component in the ultrasonic waves measured by the measurement unit in a plurality of periods separately after transmission of the ultrasonic waves from the transmitter, wherein the determination unit determines:

the condition of the range based on the intensities of the reverberant component in the ultrasonic waves measured separately in a first period and a second period being later than the first period;

a first signal level being a level of the intensity measured in the first period between binary levels including a high level and a low level in comparison with a first threshold value;

a second signal level being a level of the intensity measured in the second period between binary levels including a high level and a low level in comparison with a second threshold; and the condition of the range among the first condition, the second condition, and the third condition based on a combination of the determined first signal level and the determined second signal level.

2. The sheet conveyer device according to claim 1, wherein the determination unit determines that:

the range is in the first condition when the first signal level is determined to be the high level and the second signal level is determined to be the high level;

the range is in the second condition when the first signal level is determined to be the high level and the second signal level is determined to be the low level; and the range is in the third condition when the first signal level is determined to be the low level and the second signal level is determined to be the low level.

3. The sheet conveyer device according to claim 1, wherein the first threshold value and the second threshold value are a same value.

4. The sheet conveyer device according to claim 3, wherein the first period and the second period are in such a relationship that the intensity measured in the second period when the range is in the first condition indicates a value in a same range as a value indicating the intensity measured in the first period when the range is in the second condition.

5. The sheet conveyer device according to claim 1, wherein the first period is a period, in which the intensity measured by the measurement unit indicates a peak.

6. The sheet conveyer device according to claim 1, further comprising:

a tray disposed upstream from the range with regard to a conveying direction to convey the sheet; and a roller disposed between the tray and the range, the roller being configured to convey the sheet placed on the tray downstream in the conveying direction, wherein the determination unit is configured to execute:

a controlling process, in which the determination unit controls the transmitter to transmit the ultrasonic waves after the roller starts rotating and when the roller rotates for predetermined amount required for conveying the sheet to the range;

a determining process, in which, after the transmission of the ultrasonic waves in the controlling process, the determination unit determines the condition of the range based on the intensities of reverberant component in the ultrasonic waves measured by the measurement unit separately in the plurality of periods determined with reference to a timing of the transmission of the ultrasonic waves; and an error detecting process, in which, if the determination unit determines that the range is in the first condition in the determining process, the determination unit detects incorrect feeding with the sheet, and if the determination unit determines that the range is in the third condition in the determining process, the determination unit detects multiple feeding of the sheets.

7. The sheet conveyer device according to claim 1, wherein the determination unit comprises a comparator configured to compare a measured value indicating the intensity of the ultrasonic waves measured by the measurement unit with a threshold value.

8. The sheet conveyer device according to claim 7, wherein the determination unit further comprises a determination circuit configured to receive an output signal from the comparator to determine the condition of the range and output a determined value indicating the determined condition of the range.

9. A sheet conveyer device, comprising:

a transmitter arranged on a conveyer path to face a first side of a sheet being conveyed in the conveyer path, the transmitter being configured to transmit ultrasonic waves;

a receiver arranged on the conveyer path to face a second side of the sheet being conveyed in the conveyer path, the receiver being configured to receive the ultrasonic waves;

a measurement unit configured to measure an intensity of the ultrasonic waves received in the receiver;

a determination unit configured to determine a condition of a range in the conveyer path between the transmitter and the receiver among a first condition, in which an attenuation rate of reverberant component in the transmitted ultrasonic waves is lowest and no sheet is determined to be present in the range, a second condition, in which the attenuation rate of the reverberant component in the transmitted ultrasonic waves is higher than the first condition and a single sheet is determined to be present in the range, and a third condition, in which the attenuation rate of the reverberant component in the transmitted ultrasonic waves is higher than the second condition and a plurality of sheets are determined to be present in the range in a layer, based on intensities of the reverberant component in the ultrasonic waves measured by the measurement unit in a plurality of periods separately after transmission of the ultrasonic waves from the transmitter;

a tray disposed upstream from the range with regard to a conveying direction to convey the sheet;

a roller disposed between the tray and the range, the roller being configured to convey the sheet placed on the tray downstream in the conveying direction; and a sensor disposed downstream from the range in the conveyer path, the sensor being configured to detect the sheet passing thereby, wherein the determination unit is configured to execute:

a controlling process, in which the determination unit controls the transmitter to transmit the ultrasonic waves after the roller starts rotating and when the roller rotates for predetermined amount required for conveying the sheet to a position to be detectable to the sensor;

a determining process, in which, after the transmission of the ultrasonic waves in the controlling process, the determination unit determines the condition of the range based on the intensities of the ultrasonic waves measured by the measurement unit separately in the plurality of periods determined with reference to a timing of the transmission of the ultrasonic waves; and an error detecting process, in which, if the determination unit determines that the range is in the first condition in the determining process while the sensor detects no sheet passing thereby, the determination unit detects incorrect feeding with the sheet; if the determination unit determines that the range is in one of the second condition and the third condition in the determining process while the sensor detects no sheet passing thereby, the determination unit detects sheet jam with the sheet; and if the determination unit determines that the range is in the third condition in the determining process while the sensor detects the sheet passing thereby, the determination unit detects multiple feeding of the sheets.

10. The sheet conveyer device according to claim 9, wherein the determination unit determines the condition of the range based on the intensities of the reverberant component in the ultrasonic waves measured separately in a first period and a second period being later than the first period.

11. The sheet conveyer device according to claim 10, wherein the determination unit determines:

a first signal level being a level of the intensity measured in the first period between binary levels including a high level and a low level in comparison with a first threshold value;

a second signal level being a level of the intensity measured in the second period between binary levels including a high level and a low level in comparison with a second threshold; and the condition of the range among the first condition, the second condition, and the third condition based on a combination of the determined first signal level and the determined second signal level.

12. The sheet conveyor device according to claim 11, wherein the determination unit determines that:

the range is in the first condition when the first signal level is determined to be the high level and the second signal level is determined to be the high level;

the range is in the second condition when the first signal level is determined to be the high level and the second signal is determined to be the low level; and the range is in the third condition when the first signal level is determined to be the low level and the second signal level is determined to be the low level.

13. The sheet conveyor device according to claim 11, wherein the first threshold value and the second threshold value are a same value.

14. The sheet conveyor device according to claim 13, wherein the first period and the second period are in such a relationship that the intensity measured in the second period when the range is in the first condition indicates a value in a same range as a value indicating the intensity measured in the first period when the range is in the second condition.

15. The sheet conveyor device according to claim 10, wherein the first period is a period, in which the intensity measured by the measurement unit indicates a peak.

16. The sheet conveyor device according to claim 9, wherein the determination unit comprises a comparator configured to compare a measured value indicating the intensity of the ultrasonic waves measured by the measurement unit with a threshold value.

17. The sheet conveyor device according to claim 16, wherein the determination unit further comprises a determination circuit configured to receive an output signal from the comparator to determine the condition of the range and output a determined value indicating the determined condition of the range.

* * * * *